United States Patent [19]

Sturgis et al.

[11] Patent Number: 4,824,761

[45] Date of Patent: Apr. 25, 1989

[54] INTEGRAL FILM ASSEMBLAGE OF THE INSTANT OR SELF-DEVELOPING TYPE

[75] Inventors: John I. Sturgis, Stoneham; George D. Whiteside, Lexington, both of Mass.

[73] Assignee: Polaroid Corporation, Cambridge, Mass.

[21] Appl. No.: 137,864

[22] Filed: Dec. 24, 1987

[51] Int. Cl.[4] ..... G03L 3/00; G03D 9/02

[52] U.S. Cl. ..... 430/209; 430/207; 430/499; 354/304

[58] Field of Search ..... 430/207, 208, 209, 497, 430/498, 499; 354/304

[56] References Cited

U.S. PATENT DOCUMENTS

| | | | |
|---|---|---|---|
| 3,415,644 | 12/1968 | Land | 430/212 |
| 3,764,332 | 10/1973 | Harvey | 430/207 |
| 3,916,423 | 10/1975 | Ueda et al. | 354/108 |
| 4,042,395 | 8/1977 | Tone et al. | 430/209 |
| 4,182,559 | 1/1980 | Driscol et al. | 354/105 |
| 4,352,879 | 10/1982 | Hara | 430/209 |
| 4,490,456 | 12/1984 | Feasey | 430/207 |
| 4,556,631 | 12/1985 | Sato et al. | 430/498 |
| 4,693,963 | 9/1987 | McCole | 430/499 |

*Primary Examiner*—Richard L. Schilling
*Attorney, Agent, or Firm*—Alfred E. Corrigan

[57] ABSTRACT

A self-developing integral film assemblage or unit adapted to be advanced between a pair of liquid spreading members in a camera to distribute a processing composition between a first positive or image-receiving sheet and a second negative or image-recording sheet. The composition is supplied from a pod which is located at a leading end of the film unit and excess thereof is absorbed by a trap at a trailing end of the unit. The first and second sheets are properly spaced by an intermediate masking sheet of uniform thickness which has an image-defining aperture therein. This mask assures that a uniform thickness of the processing composition is spread between the first and second sheets. The mask may also include a cutout adjacent to and outside of the image area defined by the aperture so as to enable an underlying portion of the second sheet to be photographically exposed to indicia relating to the exposure.

2 Claims, 2 Drawing Sheets

10
11
12
13
14
15
16
17
18
19
20
21
22
23
24
25
26
27
28
29
30
31
32

INTEGRAL FILM ASSEMBLAGE OF THE INSTANT OR SELF-DEVELOPING TYPE

FIELD OF THE INVENTION

This invention relates to an integral film assemblage of the instant or self-developing type and which includes an image-receiving sheet (positive), an image-recording sheet (negative), an opaque mask having an aperture therein which is to frame the resulting positive image in the image-receiving sheet, a rupturable container of processing liquid, and a trap for absorbing the excess of the processing liquid.

DESCRIPTION OF THE PRIOR ART

Film assemblages of the instant type have been provided in various forms in the prior art. These film assemblages generally comprise two separate superposed sheets which are in the form of a first or image-recording sheet and a second or image-receiving sheet. The first sheet includes a layer containing an image-recording photosensitive material supported by an opaque outer sheet. The second sheet, which is transparent, also aids in the distribution of a viscous liquid processing agent as a layer in contact with an exposed area of the first sheet.

The two superposed sheets are generally held together by an aligning masking sheet which is secured to the two superposed sheets and which is opaque but has an aperture therein to frame the image on the image-receiving sheet. A container for the processing liquid which can be ruptured by suitable pressure is located at one end of the masking sheet and a trap for absorbing any excess of the processing liquid is located at an opposite end of the masking sheet.

Spacer means of suitable thickness are provided between the first and second sheets to provide a compartment for receiving the processing liquid.

One film assemblage or film unit of this general type is disclosed in the U.S. Pat. No. 4,042,395, granted to Tone et al. This unit uses an image area-defining intermediate member or mask positioned between the lateral edges of the superposed first and second sheets. Leading and trailing ends of the intermediate member are folded back upon themselves to form two enclosures. A forward enclosure will hold a rupturable container of processing liquid. A trailing enclosure provides a repository for excess processing liquid. In such a unit the mask serves as a multifunction sheet extending between the first and second sheets to couple them together, provides (1) a mask portion which surrounds and forms the exposure aperture, (2) spacer rail portions which give requisite spacing between the first and second sheets to furnish the necessary thickness of the layer of processing liquid and (3) a cover for a container of processing liquid at one end of the film unit and a trap cover at the other end of the film unit. According to this patent the intermediate sheet is a multithickness element of different thicknesses. The element is formed from a single sheet to provide a mask portion and container cover of a first thickness and spacer rail portions and trap cover of another greater thickness. The required differences in thickness are achieved by grinding or skiving which is time-consuming and expensive and the assembling of the intermediate or masking sheet with the other sheets is difficult due in part to the thickness differentials.

Another film unit of the general type indicated is illustrated in U.S. Pat. No. 4,693,963 to McCole. This patent discloses a film assemblage having an external mask of uniform thickness with opposite ends that are folded around the leading and trailing ends of the film assemblages. However, due to the fact that the mask is located over the positive sheet which, in turn, is located over the photosensitive or negative sheet, and not between them, it is necessary to have separate rails positioned between the sheets to control the thickness of the viscous processing liquid spread between the sheets and for sealing the lateral edges of the sheets.

SUMMARY OF THE INVENTION

The self-developing or instant film assemblage of this invention comprises a transparent top sheet which is an image-receiving or positive sheet, a lower image-recording sheet or negative, and an internal opaque mask of uniform thickness positioned therebetween. The mask has an aperture therein to frame the resulting positive image to be produced in the image-receiving sheet. The length of the mask is greater than that of the two sheets between which it is positioned and its opposite ends are folded upon themselves to enclose, respectively, a rupturable container of a processing liquid at a leading end of the film assemblage and a trap for excess processing liquid at a trailing end of the film assemblage.

The uniform thickness of the mask provides a flow path for the processing liquid from the rupturable container to the trap and thereby a layer of the liquid between the top and lower sheets which is uniform in thickness. The uniform thickness of the processing liquid insures uniform chemical application of its processing constituents to the two spaced sheets.

In an alternative embodiment of the invention one edge of the exposure aperture in the internal mask is provided with a cutout which allows an area of the image-recording sheet, located outside of the area to be exposed to scene light, to be exposed via means such as an LED (light emitting diode) display. This display may contain any suitable information such as date of exposure, exposure settings, e.g., speed and aperture settings, etc.

An object of the invention is to provide a film assemblage of the instant type having an internal mask of uniform thickness for delineating the area of a visible image in a positive sheet of the assemblage, such mask having opposite end sections adapted to be folded upon themselves to define chambers for enclosing a processing liquid at one end of the assemblage and a reservoir for receiving excess processing liquid at an opposite end thereof.

Another object of the invention is to provide a film assemblage of the type described with an internal mask having an exposure aperture for defining the area of the subject to be photographed, and a smaller offset area for defining an area of the film assemblage to be photographically exposed to indicia relating to the date of exposure and/or exposure parameters.

Other objects of the invention will in part be obvious and will in part appear hereinafter.

The invention accordingly comprises the product possessing the features, properties and the relation of components which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
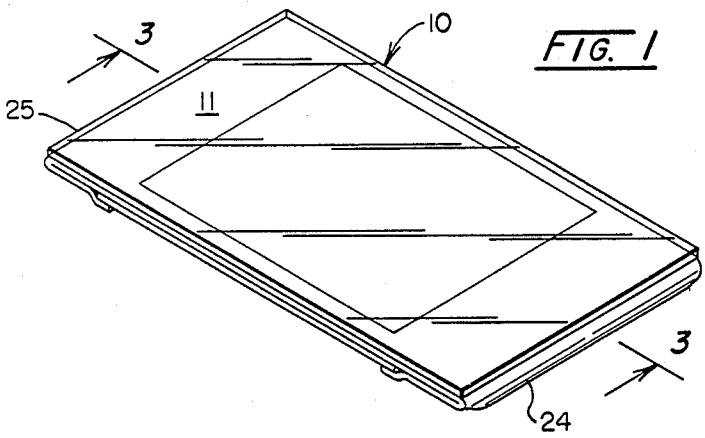
FIG. 1 is a perspective view of a film assemblage.
Figure 2:
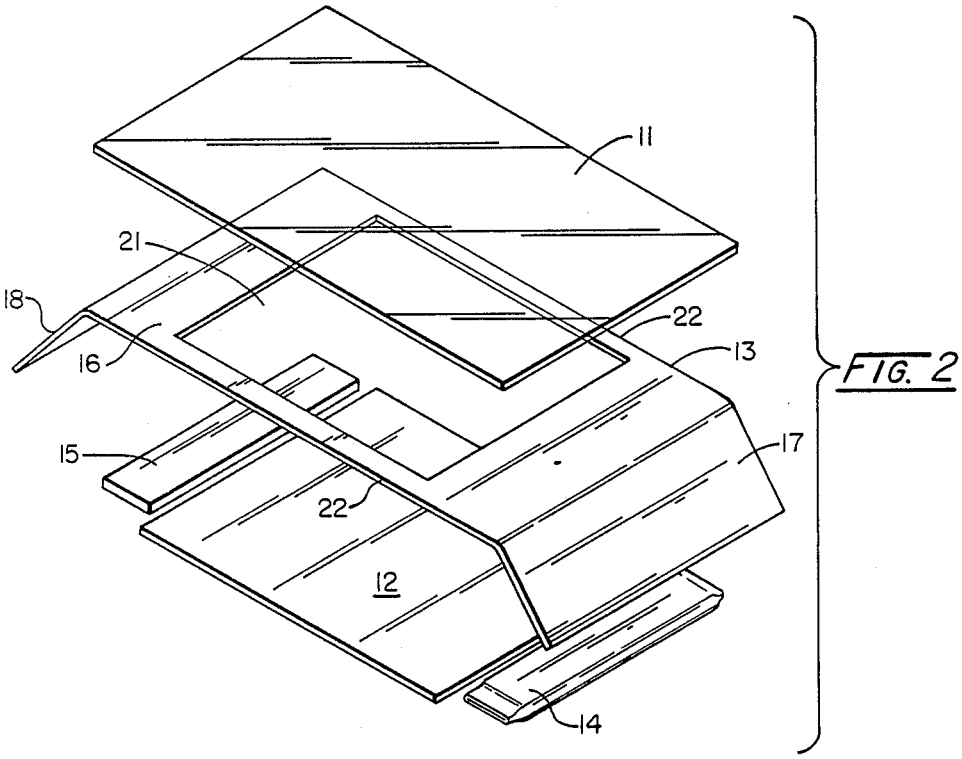
FIG. 2 is an exploded perspective view of the assemblage of FIG. 1.
Figures 3, 4, 5, 6, 7:
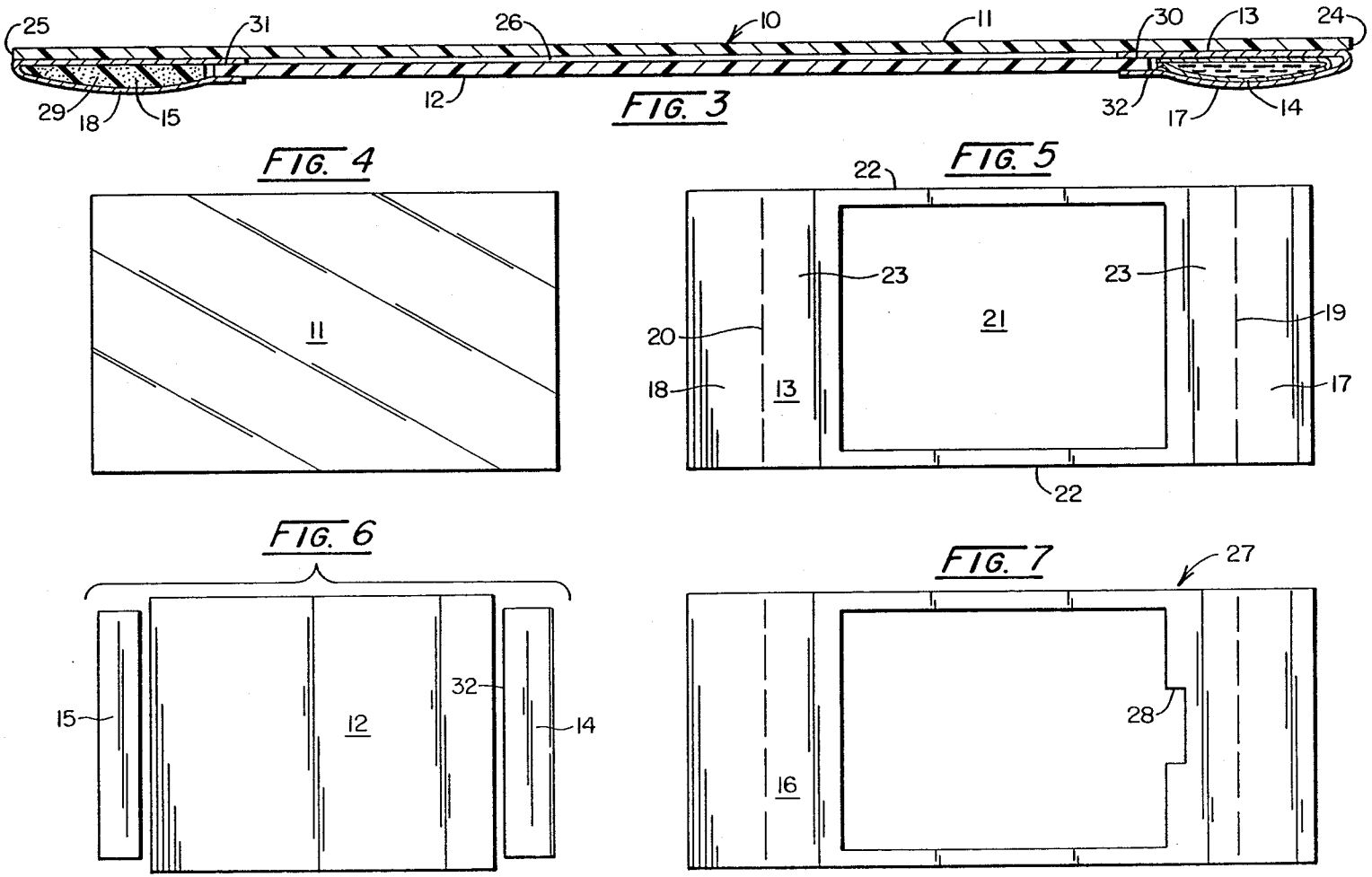
FIG. 3 is an enlarged sectional view taken along line 3—3 through the assemblage shown in FIG. 1.
FIG. 4 is a plan view of the image-receiving sheet of the assemblage of FIG. 1.
FIG. 5 is a plan view of the masking sheet of the assemblage of FIG. 2.
FIG. 6 is a plan view of the image-recording sheet and associated rupturable processing liquid container and trap for excess processing liquid.
FIG. 7 is a plan view of a modified form of the masking sheet of FIG. 5.

With reference to the drawings and particularly to FIGS. 1 to 3, a film assemblage of the instant or self-developing type is indicated generally by the numeral 10. This assemblage is shown as comprising an upper sheet 11, a lower sheet 12, an intermediate sheet or mask 13, a rupturable container 14 of processing liquid and a trap 15.

The top sheet 11 (FIG. 4) is a transparent image-receiving sheet which will ultimately contain the visible positive color image. This image-receiving sheet is the positive of the assemblage.

The lower or bottom sheet 12 (FIG. 6) is the image-recording sheet or negative having an opaque outer support. Each of the image-recording and image-receiving sheets may contain a plurality of layers and may be of the type shown in FIG. 5 of U.S. Pat. No. 3,415,644 and to the extent that it is necessary for an understanding of this invention, said patent disclosure is incorporated herein by reference.

It will be noted that sheet 11 is of the same width as the sheet 12 but that sheet 12 is of a length considerably less than that of the sheet 11 as shown in FIGS. 2 and 3.

Sheet 13 (FIG. 5) is a mask of opaque material and has a main mask area 16 which is co-extensive with the widths of the sheets 11 and 12. The sheet 13 includes first and second opposite ends in the form of flaps 17 and 18 which are folded at transverse fold lines 19 and 20 (see FIG. 5) to form enclosures or compartments whose function will be explained subsequently.

The mask sheet 13 has a rectangular aperture 21 incised or otherwise formed therein which will frame the resulting positive image in the image-receiving sheet 11 due to the formation of the parallel side rails 22 and the opposed end masking areas 23 (see FIG. 5).

The rupturable container or pod 14 (FIG. 6) contains a processing liquid of a type normally used in the art. This container 14 is of a width slightly less than the width of the sheet 13 and is located between the fold line 19 and the adjacent end of the aperture 21. The pod 14 includes a rupturable edge 32 (see FIG. 3). Note that the length of sheet 11 corresponds to the length of mask 13 between fold lines 19 and 20.

The trap 15 contains an absorbent sponge-like element 29 which is impregnated with an acid neutralizer for reducing the pH of any processing liquid which may be absorbed thereby. Similar to the pod 14, the trap 15 is of a width slightly less than the width of the sheet 13 and is located between the fold line 20 and the adjacent end of the aperture 21.

In assembling the sheets 11, 12 and 13 with the pod and element 19, the sheet 12 may be positioned beneath the sheet 13 (FIG. 3) with its lateral edges in alignment with the lateral outer edges of the main masking area 16 corresponding to the outer edges of the rails 22. The sheet 12 may then be centered longitudinally relative to the masking area 16 so that its ends extend beyond the ends of aperture 21. The pod 14 and absorbent element 29 may then be positioned transversely adjacent the opposite ends of the sheet 12 as shown in FIGS. 2 and 6 and then the opposite flaps 17 and 18 of the mask 13 folded downwardly about the respective lines 19 and 20 until their outer ends are in contact with the adjacent ends of the exterior surface of the sheet 12, thereby to enclose the respective pod 14 and absorbent element 29, as shown in FIG. 3. These flap ends are then heat-sealed transversely to the outer surface of sheet 12 to form compartments to hold their enclosed contents. Sheet 12 may be simultaneously heat sealed to the mask 13 along rails 22 or this may be performed later.

The image-receiving sheet 11 is positioned on the masking sheet 13 with all of its edges aligned with the corresponding edges of the masking area 16 and over the aperture 21. The image-recording sheet 11 is then heat sealed to all of the contacting surfaces of the underlying mask 13. Subsequently or simultaneously, the image-recording sheet 12 may be heat sealed to the rails 22 of mask 13. Note that mask 13 and sheet 12 are not bonded together in the transverse areas 30, 31 (see FIG. 3), these areas are a part of a processing liquid flow path from a ruptured pod 14 to trap 15.

A pod end 24 of the film assemblage 10 will be the leading end for ejection from a film cassette (not shown) and a trap end 25 will be the trailing end. After the film unit or assemblage 10 has been exposed while in a camera it leaves the exposure area and pressure rollers (not shown) rupture the pod 14 so that the photographic processing liquid flows into a chamber 26 formed between the sheets 11 and 12 and side rails 22. The thickness of the rails 22 determines the spacing of the sheets 11 and and 12 which form the chamber 26 whereby, a predetermined thickness of coating of the processing liquid is applied between the sheets 11 and 12. Excess processing liquid will pass from the chamber 26 to the trap 15 through area 31.

In FIG. 7 there is illustrated a modification of the opaque mask which is indicated generally by the reference character 27 and will replace the opaque mask 13 of the assemblage 10 previously described. This mask 27 differs from the mask 13 by having a cutout 28 such that the underlying image-recording sheet of the assemblage may be photographically exposed, the image-recording sheet 12 or negative in this instance being extended into the trap area and the trap being narrower than the trap 15 so as to accommodate the increased length of the negative. The area underlying the cutout 28 may be exposed via an LED display (not shown) mounted in a camera with either the date, exposure speed, aperture setting or other desired indicia. Such an LED display is shown in U.S. Pat. No. 4,182,559 although it is not a part of the camera. In this embodiment a film cassette which would contain a stack of these film assemblages 10 would be provided with a corresponding cutout in its exposure facing forward wall so as to enable such indicia to be recorded on the film assemblage.

It will be apparent from the preceding description that this invention provides a film assmblage or unit adapted to be moved so that its leading end enters between pressure applying members which in turn rupture a pod and distribute a processing composition within said film unit toward its trailing end. The film unit comprises first and second sheets, positive and negative, of substantially equal widths. An opaque mask sheet of uniform thickness is provided between the first and second sheets and has an aperture therein defining an image area such that side rails are provided at its lateral edges which have their outer edges aligned with the corresponding edges of the superposed first and second sheets. The rupturable pod for the processing composition is enclosed in a chamber formed by a folded extension of the mask at one end and absorbent material for absorbing excess processing liquid is enclosed within a chamber or trap formed by a folded extension of the mask at its other end. The side rails of the mask serve to space the first and second sheets to form a chamber for receiving the processing liquid from the pod ruptured by the pressure-applying members and allowing it to flow in a layer of predetermined thickness rearwardly with any excess entering the trap, thereby supplying the proper amount of processing liquid between the first and second sheets for proper processing of the film. The rails on the intermediate masking sheet are fixedly secured to the lateral margins of the superposed image-receiving and image-recording sheets and their function is to determine the thickness of the processing liquid composition spread between the sheets as well as to prevent leakage of the processing liquid. The rails are also secured to the interior surfaces of the image-receiving sheet in the pod and trap areas of the film unit. If desired, the intermediate masking sheet may be provided with a cutout at one of the edges of the image-forming aperture. The cutout would be located above an underlying extension of the negative second sheet so that certain desired indicia may be photographically exposed upon the second sheet and subsequently transferred to the first sheet by diffusion of the image during processing.

Since certain changes may be made in the above described invention without departing from the scope thereof, it is intended that all matter contained in the above description or shown in the accompanying drawings shall be interpreted as illustrative and not in a limiting sense. For example, while the cutout described above has one side in common with the aperture in the mask, it could be spaced therefrom so as to define its own separate smaller aperture.

What is claimed is:

1. A self-developing integral film unit having leading and trailing ends and adapted to be advanced leading end first between pressure-applying means to distribute a processing liquid within said unit from said leading end to said trailing end comprising:

first and second superposed image-receiving and image-recording sheets;

an intermediate opaque masking sheet of uniform thickness throughout disposed between said first and second sheets and having an aperture therein for defining an image-receiving area in said first sheet, said intermediate masking sheet also being provided with a cutout extending outwardly from said aperture through which an extended area of said image-recording sheet may be exposed to indicia representative of the date of exposure or an exposure parameter;

a pod containing processing liquid located adjacent said leading end of said film unit, said pod being rupturable when said unit is passed between the pressure-applying means;

means forming a trap at said trailing end of said film unit for receiving excess processing liquid;

said masking sheet being of a desirable uniform thickness to properly space said first and second sheets to form a chamber therebetween extending between said pod and said trap through which said processing liquid is spread in a layer of thickness substantially equal to the thickness of said masking sheet to act on photosensitive constituents in said second sheet to form a visible image in said first sheet; and, said masking sheet further includes first and second opposite ends, said first end being folded back upon itself and being transversely sealed throughout its entire width to an external surface of said second sheet so as to define a compartment for housing said pod, and said second end being folded back upon itself and being transversely sealed throughout its entire width to an external surface of said second sheet so as to define a compartment for housing said trap.

2. A self-developing integral film unit having leading and trailing ends and adapted to be advanced leading end first between pressure-applying means to distribute a processing liquid within said unit from said leading end to said trailing end comprising:

first and second superposed image-receiving and image-recording sheets;

an intermediate opaque masking sheet of uniform thickness throughout disposed between said first and second sheets and having an aperture therein for defining an image-receiving area in said first sheet, said masking sheet also being provided with a cutout adjacent an edge of said aperture through which an underlying area of said image-receiving second sheet may be exposed by an LED array in a camera to reproduce indicia at said edge of said aperture formed on said image-receiving sheet;

a pod containing processing liquid located adjacent said leading end of said film unit, said pod being rupturable when said unit is passed between the pressure-applying means;

means forming a trap at said trailing end of said film unit for receiving excess processing liquid;

said masking sheet being of a desirable uniform thickness to properly space said first and second sheets to form a chamber therebetween extending between said pod and said trap through which said processing liquid is spread in a layer of thickness substantially equal to the thickness of said masking sheet to act on photosensitive constituents in said second sheet to form a visible image in said first sheet; and, said masking sheet further includes first and second opposite ends, said first end being folded back upon itself and being transversely sealed throughout its entire width to an external surface of said second sheet so as to define a compartment for housing said pod, and said second end being folded back upon itself and being transversely sealed throughout its entire width to an external surface of said second sheet so as to define a compartment for housing said trap.

* * * * *